United States Patent [19]

Pierlot et al.

[11] 3,961,719

[45] June 8, 1976

[54] CAP WHICH CAN BE PACKAGED WITHOUT DANGER OF WEDGING

[75] Inventors: Bernard Pierlot; Georges Potaufeu, both of Clisalu, France

[73] Assignee: Clisalu, Mareul, France

[22] Filed: Feb. 24, 1975

[21] Appl. No.: 552,431

[30] Foreign Application Priority Data

Feb. 28, 1974 Luxemburg ..... 69513

[52] U.S. Cl. ..... 215/277; 206/445; 206/520; 215/326; 215/348

[51] Int. Cl.[2] ..... B65D 41/62

[58] Field of Search ..... 215/348, 350, 353, 326, 215/250, 277; 206/516, 519, 520, 445

[56] References Cited

UNITED STATES PATENTS

| | | | |
|---|---|---|---|
| 1,787,959 | 1/1931 | Scofield | 215/350 X |
| 2,131,438 | 9/1938 | Jensen | 215/326 |
| 2,427,699 | 9/1947 | Aronovsky | 215/348 |
| 2,670,076 | 2/1954 | Monks | 206/516 |
| 3,006,493 | 10/1961 | Acton | 215/350 X |
| 3,415,034 | 12/1968 | Schmitt | 206/520 X |
| 3,442,411 | 5/1969 | Mahoney | 215/348 |
| 3,526,316 | 9/1970 | Kalogris | 206/520 X |

FOREIGN PATENTS OR APPLICATIONS

| | | | |
|---|---|---|---|
| 1,115,148 | 10/1961 | Germany | 215/326 |
| 453,661 | 12/1949 | Italy | 206/519 |

*Primary Examiner*—Donald F. Norton
*Attorney, Agent, or Firm*—McDougall, Hersh & Scott

[57] ABSTRACT

For the capping of champagne bottles long skirt caps of frustoconical shape are used. These caps of thin metal foils are very fragile and bulky. Generally they are stacked one in another for shipping. To avoid any risk of the stacked caps being wedged into each other, their bottom is filled with a foamed thermoplastic washer. It is either detachable or injected cold.

4 Claims, 4 Drawing Figures

CAP WHICH CAN BE PACKAGED WITHOUT DANGER OF WEDGING

The present invention relates to an arrangement of bottle caps of frustoconical shape and more specifically to bottle caps intended for the capping of stoppers for bottles containing champagne and sparkling wines.

These caps which also are called "long skirt caps" are shaped by a rolling to a frustoconical shape from a thin foil, such as aluminum, cut to size.

The caps thus obtained are very fragile and bulky; also, in order to protect them against the danger of damage on the one hand, and to reduce the packages, used to ship them to the site of use, to volumes compatible with the transportation standards, they are stacked in each other to form sticks. In this stick-like form, the caps are placed into the automatic distributors which feed the caps for use.

The first task of the distributor, located upstream or connected automatically to the capping machine, is to separate the caps from each other or to be able to present them one by one onto the neck of the bottles which pass below in the packaging line.

Now, as a result of the shipment and the various handlings, the stick-like caps have a tendency of wedging into each other and frequently it is difficult to separate them. This results in distribution problems which slows down the capping line, causing stops due to the manual separation of the caps which often present themselves in pairs. This results in a loss of time, frequently accompanied by the destruction of one of the two caps.

A partial solution already has been found by forming a depression in the skirt close to its bottom. The improvement thereby obtained was very substantial. However, the increase in speed of the packaging cycle means that the unpacking of the caps has to be effected at higher and higher speeds. Thus it becomes necessary to add other precautions to eliminate the slightest danger of wedging.

In order to arrive at this result, the bottom of the long skirt bottle cap is filled with a porous thermoplastic foam.

This substance may be introduced in the form of a detachable washer. It also may be introduced by cold injection.

The invention is described by examples and with the aid of the drawings attached hereto which are in no way limitative. In these drawings.

In the four figures, the caps are represented in section.

Figure 1:
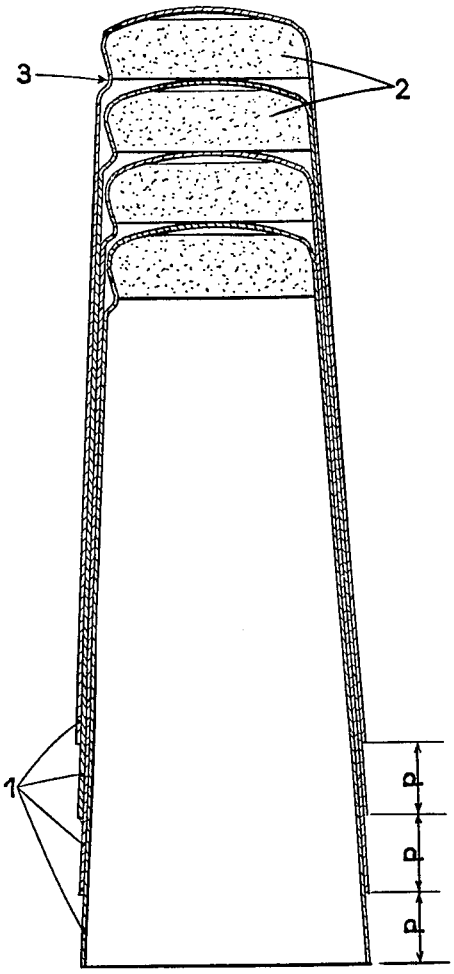
FIG. 1 is a sectional elevational view showing the position of the caps arranged in sticks.

The caps 1, shown in FIG. 1, are encased in a pitch *p* of 12 mm. At their bottoms, a mass of thermoplastic foam 2 extends to the proximity of the deepest part of a notch 3 placed close to its bottom. In fact, particularly in case of the foam in a washer, this notch 3 also is used to hold the washer.

Figure 2:
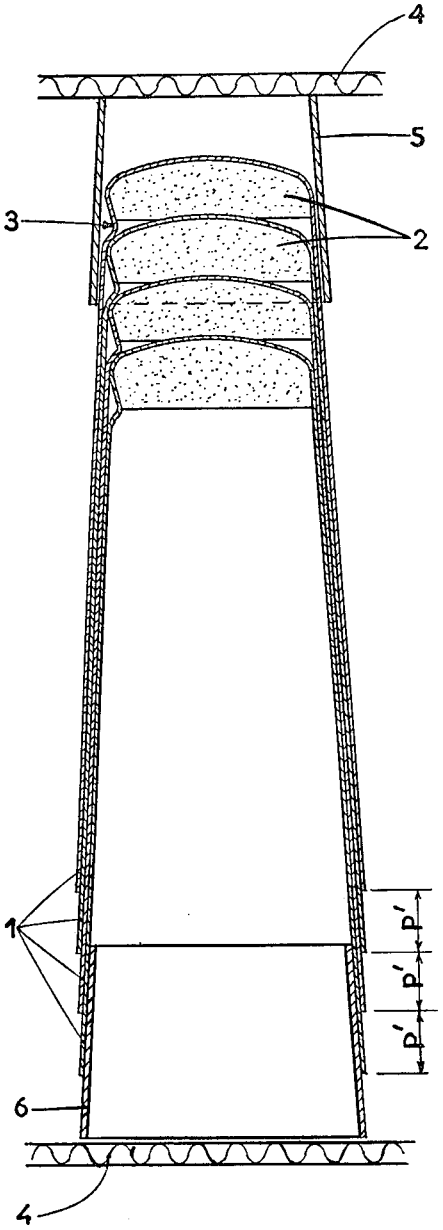
FIG. 2 is a sectional elevational view showing a "stick" applied in a package.

The notch 3 commences to play its part when the caps are prepared for packing (FIG. 2). Before placing the sticks in the boxes 4, the height of these sticks is capped to a frustoconical hollow tip 5, while an analogous hollow tip 6 is introduced into the opening of the last cap; the entire assembly is compressed slightly to form a spring between the two walls of the box 4, while the tips of the notches 3 seat on the bottom of the caps encased immediately therebelow. The pitch *p* between two skirts is reduced to 10 mm and the end of the cap compresses slightly the foam 2. So prepared, the caps can undergo all the hazards of shipping and storage in any position without any danger of the caps being wedged, and the unpacking, even if the sticks are placed on the capping machines by unskilled hands, causes no problem. On the contrary, the expansion of the foam previously causes a slight spreading apart of the caps.

Figure 3:
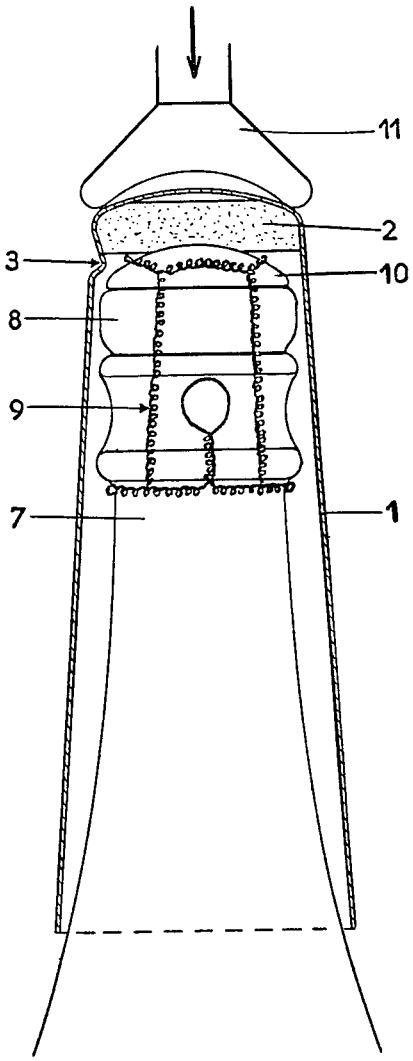
FIG. 3 is an elevational view showing a cap placed on a pack prior to the seating operation.
Figure 4:
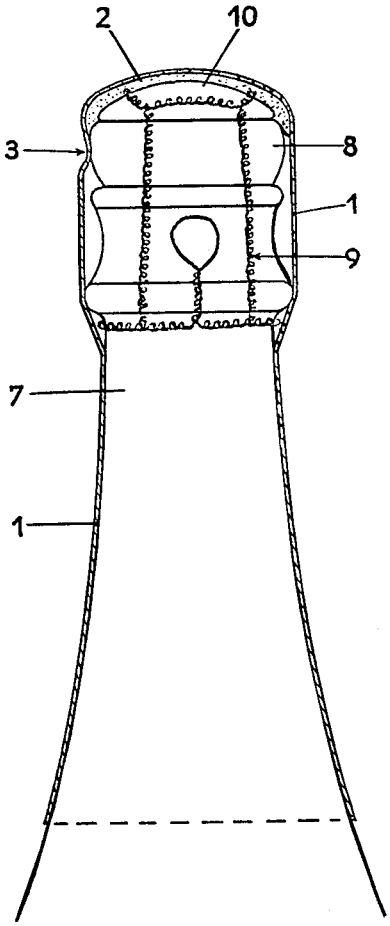
FIG. 4 is an elevational view showing a seated cap.

Another advantage of the foam layer on the bottom of the cap is discovered at the moment of the fastening of same on the neck of the bottle (FIGS. 3 and 4). The neck 7 is closed by a stopper 8 one-third of which exceeds the ring and forms the well known padding on this type of bottle. Under the interior pressure, this stopper has a tendency of escaping and thus it must be held by a wiring 9, generally formed of twisted wires. These wires cross on the upper side of the stopper, which is protected by a metal plate 10, the role of which consists of preventing the penetration of the metal wires into the cork of the stopper, as can sometimes be noted on the lateral front of the padding.

The wires of the wiring system create, at the height of the stopper, an unequal surface, which poses a problem at the time of capping because, under the pressure of the piston 11, which keeps the cap 1 in place while the seating is operated on the outer side of the neck, the bottom of the cap is in danger of being torn. The adjustment of the pressure of piston 11 thus is very delicate, because it is necessary to find a mean between the danger of piercing and the danger of shifting of the cap.

By introducing the foam mass 2 into the bottom of the cap, this danger disappears, and the piston 11 can exert its pressure without precaution until it almost completely compresses the thermoplastic foam 2 and reduces it to a thin layer 2', without danger of a lateral spread of the material, as is the case with joints of thermoplastic material used in these rigid metal caps. The padding of the cork or stopper 8 thus may, if the inner pressure requires it, develop normally without being hampered by an extraneous material which then would inevitably be pushed back across the thin wall of the cap.

Tests have been conducted and result obtained will hereinafter be exemplified with a mass of thermoplastic foam material which had been introduced into the bottom of the cap:

For the standard champagne bottles, this washer 2 has a diameter of 34 mm and a thickness of 9 mm. The material used may be a PVC foam and satisfactory results were obtained with a product having a rate of compressibility of 12 mm/kg, which means, in other words, that if the pitch between two caps, placed in stock form and prepared in a package, is 10.4 mm, it is reduced under a load of 0.5 kg, to 4.4 mm. Placed under a load of 5 kg for 2 hours the washer only comes to a thickness of 8.7 mm.

It also was possible to note that the diameter of the washers practically does not change under any load.

Tests conducted with thermoplastic foam material injected cold produced results similar in all points.

We claim:

1. In a cap adapted to be applied to enclose a previously sealed open end of a bottle, in which the cap is formed of foil, a bottom wall and a long skirt of frustoconical shape extending from the bottom wall dimensioned to have a length greater than the diameter of the cap, and a notch in the skirt portion closely spaced from the bottom wall, a means for protecting the cap and for maintaining the cap in an easily separable relation when a plurality of such caps are telescoped one within another in a stack comprising a cushion of foam material in the interior of the cap adjacent the bottom wall and extending from the bottom wall to the said notch.

2. A bottle cap as claimed in claim 1 in which the cushion of foam is a foamed thermoplastic.

3. A plurality of caps, as claimed in claim 1, in which the caps are telescoped one within the other in a stacked relation and means engaging the uppermost and lowermost caps in the stack to maintain the stack under compression whereby the space between adjacent caps in the stack is less than the normal thickness of the cushion layer whereby the cushion layers are under compression while the caps are in their stacked relation.

4. A bottle cap according to claim 1, characterized by the fact that the thermoplastic foam is injected into the cap.

* * * * *